US005515978A

United States Patent [19]

Moran

[11] Patent Number: 5,515,978

[45] Date of Patent: May 14, 1996

[54] DEVICE FOR SUPPORTING CAPS AND OTHER OBJECTS IN AN ORGANIZED MANNER

[76] Inventor: James E. Moran, 2504 Foxcroft Way, Reston, Va. 22091

[21] Appl. No.: 359,552

[22] Filed: Dec. 20, 1994

[51] Int. Cl.[6] ..... A47F 5/00

[52] U.S. Cl. ..... 211/30; 211/89; 211/113

[58] Field of Search ..... 211/30, 32, 89, 211/113, 118, 117, 115, 116

[56] References Cited

U.S. PATENT DOCUMENTS

| | | | |
|---|---|---|---|
| 717,439 | 12/1902 | McCloskey | 211/116 |
| 1,937,646 | 12/1933 | Fletcher | 211/113 X |
| 2,506,910 | 5/1950 | Wagener | 211/113 |
| 2,580,193 | 12/1951 | Richterkessing | 211/113 |
| 3,420,383 | 1/1969 | Raynor | 211/113 |
| 4,291,810 | 9/1981 | Rubenstein | 211/89 |
| 5,115,921 | 5/1992 | Lavelle | 211/89 X |
| 5,121,842 | 6/1992 | Osborne | 211/30 X |
| 5,265,737 | 11/1993 | Freeby | 211/115 X |
| 5,437,378 | 8/1995 | Ta | 211/116 X |

*Primary Examiner*—Robert W. Gibson, Jr.

[57] ABSTRACT

A device for supporting objects in an organized manner comprising a vertical post formed of a rigid material having an upper end, a lower end, and a common cross-sectional configuration therebetween, the cross-sectional configuration including one flat extent along at least a portion of the circumference of the post; an upper end cap secured to the upper end of the support rod; a hook having a curved upper end positionable over a bar of a closet or other support such as a wall mounted hook and having a lower end formed with threads, the threads being threadably positioned into the upper end of the support bar; a plurality of clips, each clip being secured at spaced locations along the length of the post for supporting individual objects being formed with a pair of similarly shaped components, each component having an exterior flat section and angled interior sections to allow the pivoting thereof at an intermediate point to open and close the fingers of the clip, each clip also having a coil spring coupled between the opposed components tending to urge the fingers of the clip in a closed position; and an adhesive coupling the clips to the post with the clips being at spaced locations along the length thereof for supporting individual objects.

2 Claims, 4 Drawing Sheets

DEVICE FOR SUPPORTING CAPS AND OTHER OBJECTS IN AN ORGANIZED MANNER

BACKGROUND OF THE INVENTION

1. Field of the Invention

The present invention relates to a device for supporting caps and other objects in an organized manner and more particularly pertains to organizing items of apparel or other objects on a device having a plurality of spaced clips for supporting the objects in a most organized manner.

2. Description of the Prior Art

The use of devices for removably supporting a wide variety of objects through a wide variety of mechanisms is known in the prior art. More specifically, devices for removably supporting a wide variety of objects through a wide variety of mechanisms heretofore devised and utilized for the purpose of organizing and supporting objects are known to consist basically of familiar, expected, and obvious structural configurations, notwithstanding the myriad of designs encompassed by the crowded prior art which has been developed for the fulfillment of countless objectives and requirements.

By way of example, the prior art in U.S. Pat. No. 4,709,838 discloses a multiple purpose hanger.

U.S. Pat. No. 5,002,190 discloses a type of sports cap rack.

U.S. Pat. No. 5,038,941 discloses another type of a hat rack.

U.S. Pat. No. 5,244,102 discloses a cap receiving apparatus.

U.S. Pat. No. 5,265,737 discloses a portable, swivel visor cap rack.

In this respect, the device for supporting caps and other objects in an organized manner according to the present invention substantially departs from the conventional concepts and designs of the prior art, and in doing so provides an apparatus primarily developed for the purpose of organizing items of apparel or other objects on a device having a plurality of spaced clips for supporting the objects in a most organized manner.

Therefore, it can be appreciated that there exists a continuing need for a new and improved device for supporting caps and other objects in an organized manner which can be used for organizing items of apparel or other objects on a device having a plurality of spaced clips for supporting the objects in a most organized manner. In this regard, the present invention substantially fulfills this need.

SUMMARY OF THE INVENTION

In view of the foregoing disadvantages inherent in the known types of devices for removably supporting a wide variety of objects through a wide variety of devices and mechanisms now present in the prior art, the present invention provides an improved device for supporting caps and other objects in an organized manner. As such, the general purpose of the present invention, which will be described subsequently in greater detail, is to provide a new and improved device for supporting caps and other objects in an organized manner and method which has all the advantages of the prior art and none of the disadvantages.

To attain this, the present invention essentially comprises a new and improved device for supporting caps and other objects in an organized manner on a bar of a closet or a wall mounted hook or the like comprising, in combination, a vertical post formed of a rigid wood having an upper end, a lower end, and a common cross-sectional configuration therebetween, the cross-sectional configuration including one flat extent along at least a portion of the circumference of the post; a lower end cap secured by glue at the lower end of the post; an upper end cap secured by glue at the upper end of the post; a hook having a curved upper end positionable over a bar of a closet or from a wall hook and having a lower end formed with screw threads, the screw threads being threadably positioned into the upper end cap and the upper end of the post; a plurality of clips, each clip being formed with a pair of similarly shaped components, each component having a flat exterior section and an angled interior section at one end of the clip to allow the pivoting thereof at an intermediate point to open and close the other end of the clip, each clip also having a coil spring coupled between the components tending to urge the other end of the clip in a closed gripping orientation; and an adhesive coupling the clips to the post and the clips being at spaced locations along the length thereof for supporting individual objects.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent of legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved device for supporting caps and other objects in an organized manner which has all the advantages of the prior art devices for removably supporting a wide variety of objects through a wide variety of devices and mechanisms and none of the disadvantages.

It is another object of the present invention to provide a new and improved device for supporting caps and other objects in an organized manner which may be easily and efficiently manufactured and marketed.

It is a further object of the present invention to provide a new and improved device for supporting caps and other objects in an organized manner which is of durable and reliable constructions.

An even further object of the present invention is to provide a new and improved device for supporting caps and other objects in an organized manner which is susceptible of a low cost of manufacture with regard to both materials and labor, and which accordingly is then susceptible of low prices of sale to the consuming public, thereby making such device for supporting caps and other objects in an organized manner economically available to the buying public.

Still yet another object of the present invention is to provide a new and improved device for supporting caps and other objects in an organized manner which provides in the apparatuses and methods of the prior art some of the advantages thereof, while simultaneously overcoming some of the disadvantages normally associated therewith.

Still another object of the present invention is to organize items of apparel or other objects on a device having a plurality of spaced clips for supporting the objects in a most organized manner.

Lastly, it is an object of the present invention to provide a new and improved device for supporting objects in an organized manner comprising a vertical post formed of a rigid material having an upper end, a lower end, and a common cross-sectional configuration therebetween, the cross-sectional configuration including one flat extent along at least a portion of the circumference of the post; an upper end cap secured to the upper end of the support rod; a hook having a curved upper end positionable over a bar of a closet or from a wall hook and having a lower end formed with threads, the threads being threadably positioned into the upper end of the support bar; a plurality of clips, each clip being secured at spaced locations along the length of the post for supporting individual objects being formed with a pair of similarly shaped components, each component having an exterior flat section and angled interior sections to allow the pivoting thereof at an intermediate point to open and close the fingers of the clip, each clip also having a coil spring coupled between the opposed components tending to urge the fingers of the clip in a closed position; and an adhesive coupling the clip to the post and the clips being at spaced locations along the length thereof for supporting individual objects.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
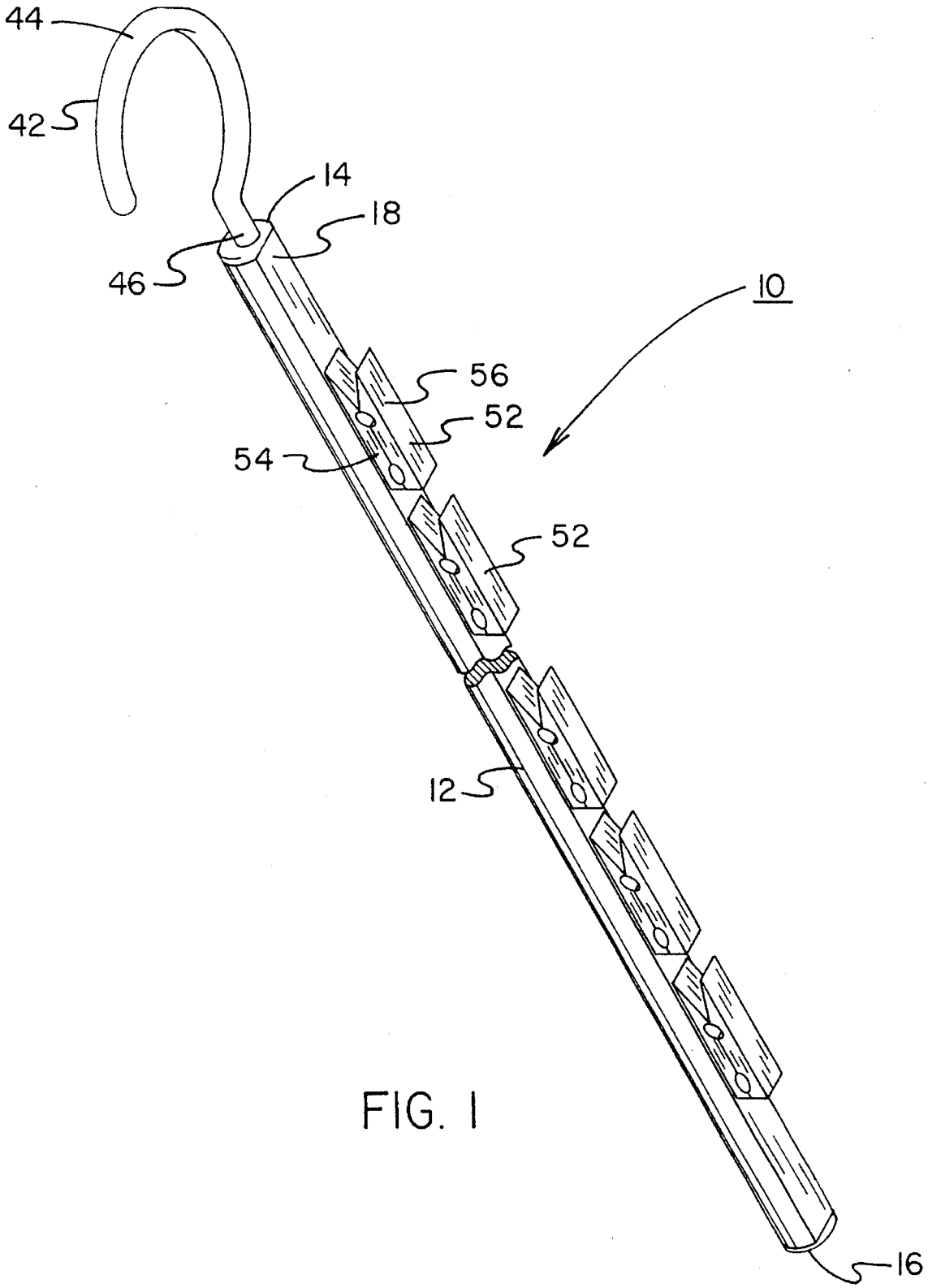
FIG. 1 is a perspective view of the preferred embodiment of the new and improved device for supporting caps and other objects in an organized manner constructed in accordance with the principles of the present invention.
Figure 2:
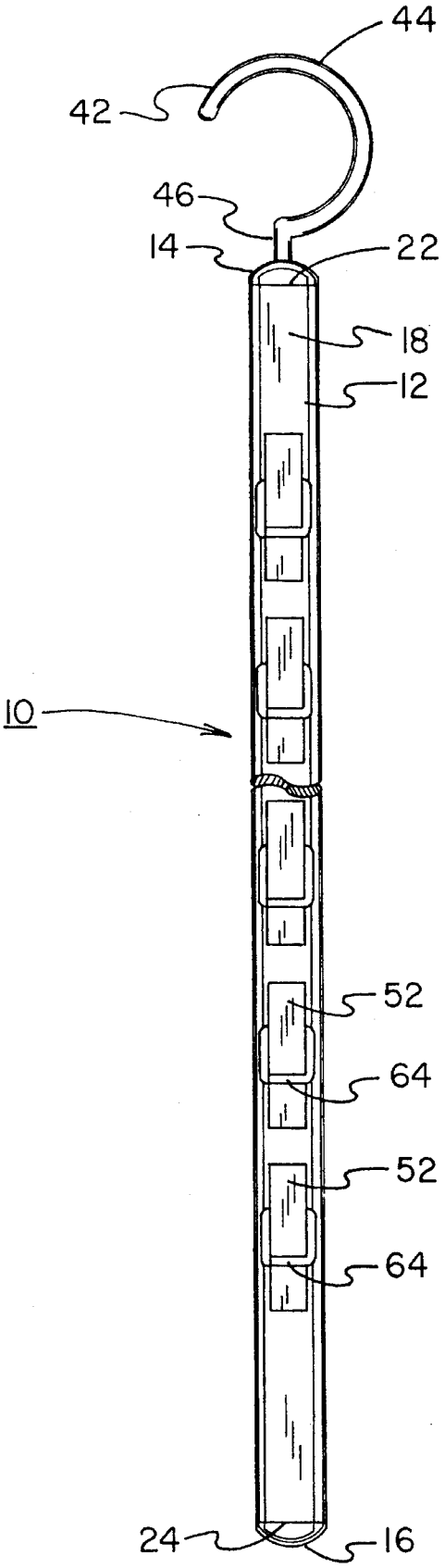
FIG. 2 is a front elevational view of the device shown in FIG. 1.
Figure 3:
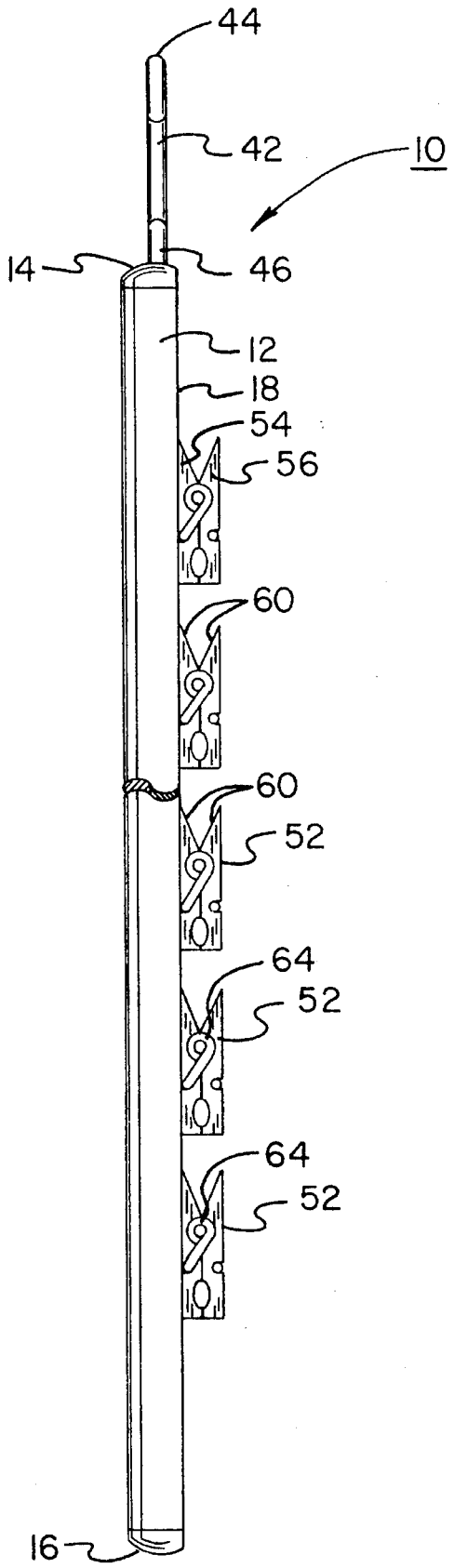
FIG. 3 is a side elevational view of the device shown in the prior two Figures.
Figure 4:
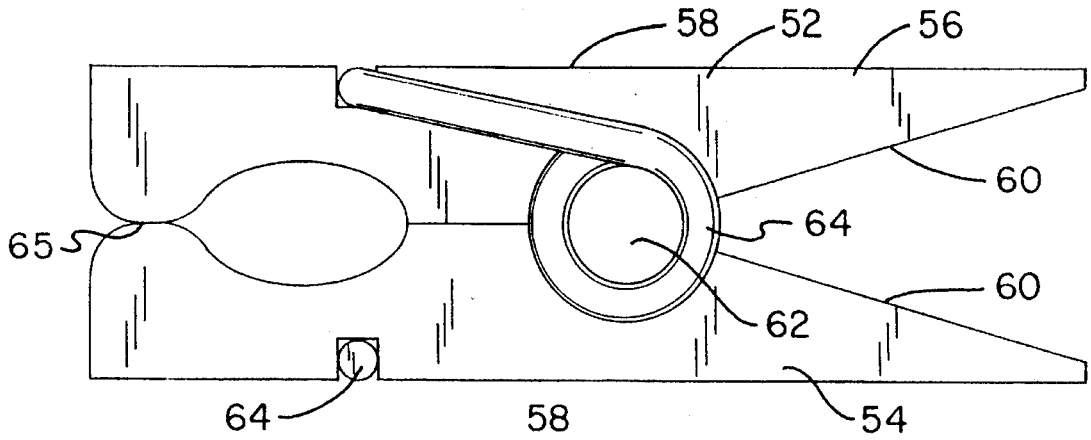
FIG. 4 is an enlarged side elevational view of one of the clips shown in the prior Figures.
Figure 5:
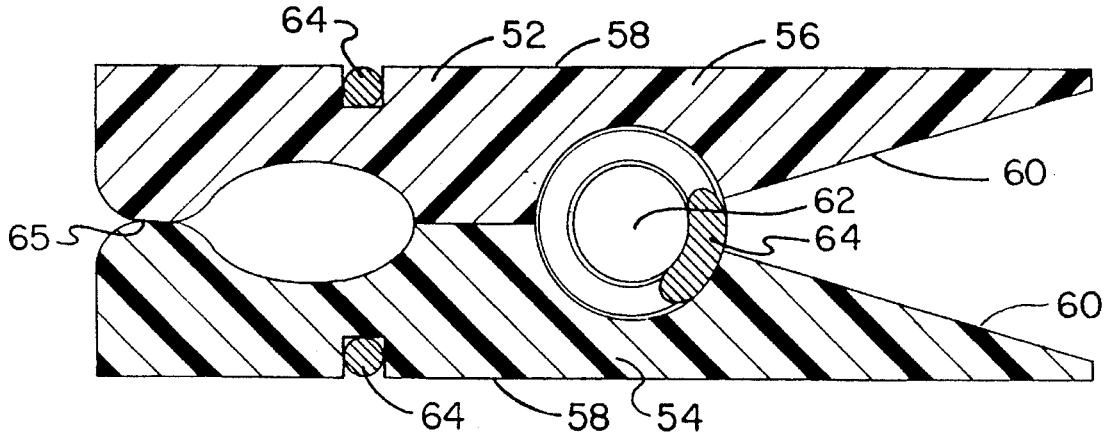
FIG. 5 is a cross-sectional view through the center of the clip shown in FIG. 4.
Figure 6:
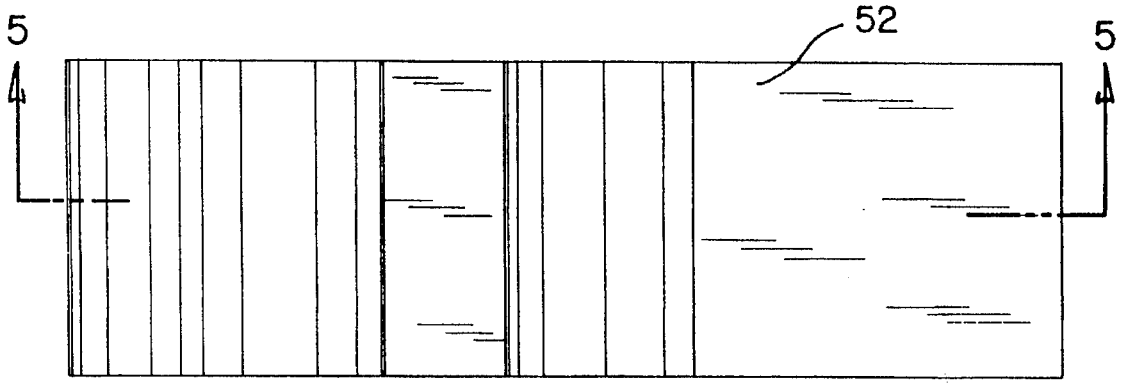
FIG. 6 is a bottom elevational of the clip shown in FIGS. 4 and 5.
Figure 7:
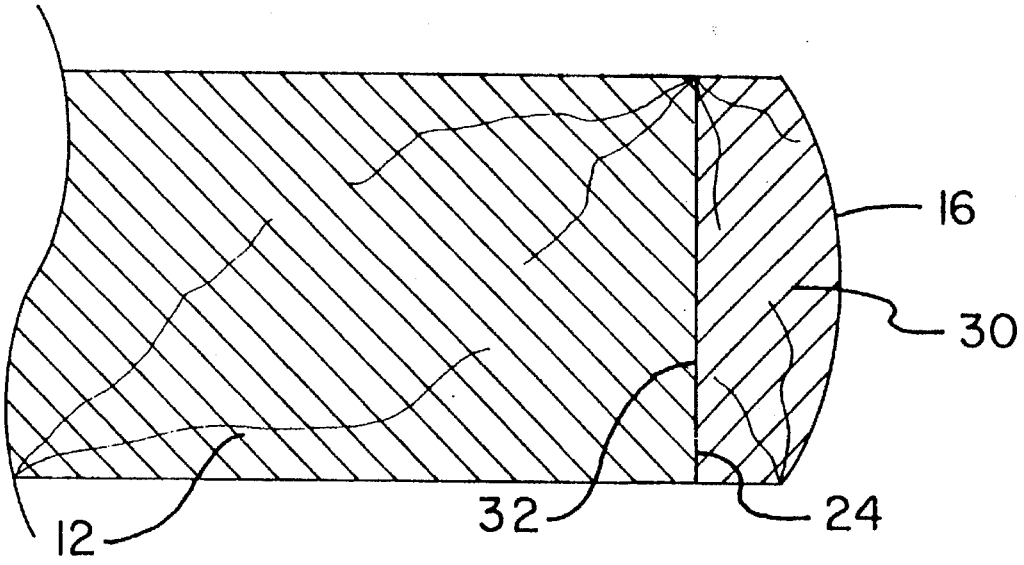
FIG. 7 is a cross-sectional view through the bottom of the device shown in FIGS. 1, 2 and 3.
Figure 8:
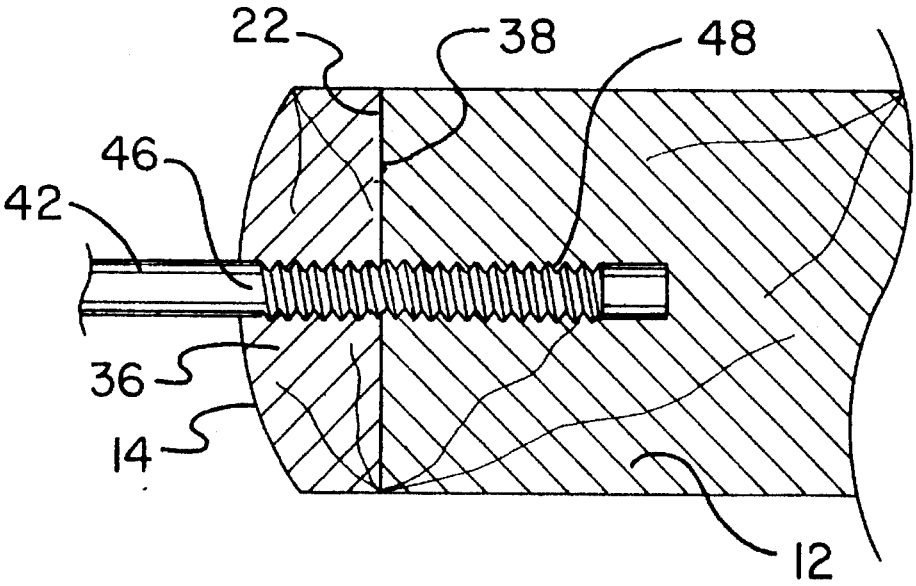
FIG. 8 is a cross-sectional view taken through the top of the device shown in FIGS. 1, 2 and 3.

With reference now to the drawings, and in particular to FIG. 1 thereof, the preferred embodiment of the new and improved device for supporting caps and other objects in an organized manner embodying the principles and concepts of the present invention and generally designated by the reference numeral 10 will be described.

The present invention, the new and improved device for supporting caps and other objects in an organized manner, is comprised of a plurality of components. Such components comprise a vertical post, a lower end cap, an upper end cap, a hook, a plurality of clips, and an adhesive. Such components are individually configured and correlated with respect to each other so as to attain the desired objective.

The central component of the system 10 of the present invention is a vertical post 12. Such post is formed of a rigid material, preferably wood. It has an upper end 14. It also has a lower end 16. Between the upper and lower ends, the post is of a common cross-sectional configuration. The cross-sectional configuration includes at least one flat side 18. Such flat side extends along at least the majority of the portion of the circumference of the vertical post.

The upper end 22 and the lower end 24 of the vertical post are formed with planar surfaces 16 and 18. A lower end cap 30 is provided with a surface 32 which is secured at the lower end of the post. Coupling there is preferably effected by glue or an adhesive.

Similarly configured is an upper end cap 36. The upper end cap is provided with a projection 38. Such end cap and projection are secured at the upper end of the post. Coupling is preferably effected through an adhesive or glue.

Next provided is a hook 42. The hook has a curved upper end 44 positionable over a bar of a closet or other like elevated supporting member. The hook has a lower end 46. The lower end is formed with threads 48. The threads are threadably positioned into the upper end cap and the upper end of the vertical post.

The next major component of the system 10 of the present invention is a plurality of clips 52. Each clip is of a similar construction and is formed with a pair of similarly shaped facing components 54 and 56. Each such component has a flat exterior section 58. It also has an angled interior section 60 at one end of the clip. This is to allow the pivoting of one component of the clip with respect to the other at an intermediate point 62. This is to open and close the opposite or other end 65 of the clip. Each clip also has a coil spring 64 secured between the components. The spring tends to urge the other end of the clip in a closed gripping orientation. Note FIG. 1.

The final component of the system 10 is an adhesive or glue. Such adhesive is for effecting the coupling between the clips and vertical post. The clips are preferably spaced along the post at evenly spaced vertical locations along the length of the post. This is for the complete and organized supporting of individual objects, preferably hats.

The present invention comprises a practical hanging cap organizer which conveniently holds up to six caps at one time. It can be mounted on any wall or hung in a closet.

The present invention, in its preferred embodiment, is manufactured from a ¾ inch wooden dowel which measures 18 inches in length. This dowel includes a brass-plated hook for hanging at the top, while the bottom features a rounded tip. Six mini-clothespins, measuring 2¼ inches each, are attached along the length of the dowel. The first clothespin is placed 2 inches from the top, while the remaining five are positioned ½ inch apart. A hard light-colored wood, such as maple or birch, is best suited for this device. In addition, a longer dowel and more clothespins may be used to allow more caps to be stored.

Any cap which features a bill or large visor may be stored on this device. The cap is attached by opening the clothespin and placing the bill of the cap into the open area. As the pin is closed, the cap is securely attached into place on the dowel. The unit can then be mounted on the wall or hung on a closet rod. The easy pressure applied by the clothespin allows the cap to remain in place but does not create any damage or leave any marked impressions or indentations on the bill of the cap.

This completely portable and practical device provides convenient storage of caps while the attractive, wooden structure is durable and long-lasting.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A new and improved device for supporting caps and other objects in an organized manner comprising, in combination:

a vertical post formed of a rigid wood having an upper end, a lower end, and a common cross-sectional configuration therebetween, the cross-sectional configuration including one flat extent along at least a portion of the circumference of the post;

a lower end cap secured at the lower end of the post;

an upper end cap secured at the upper end of the post;

a hook having a curved upper end positionable over a bar of a closet and having a lower end formed with screw threads the screw threads being threadably positioned into the upper end cap and the upper end of the post;

a plurality of clips, each clip being formed with a pair of similarly shaped components, each component having a flat exterior section and an angled interior section at one end of the clip to allow the pivoting thereof at an intermediate point to open and close the other end of the clip, each clip also having a coil spring coupled between the components tending to urge the other end of the clip in a closed gripping orientation; and an adhesive coupling the clips to the post at spaced locations along the length thereof for supporting individual objects.

2. A device for supporting objects in an organized manner comprising:

a vertical post formed of a rigid material having an upper end, a lower end, and a common cross-sectional configuration therebetween, the cross-sectional configuration including one flat extent along at least a portion of the circumference of the post;

an upper end cap secured to a upper end of the support rod;

a hook having a curved upper end positionable over a support bar of a closet and having a lower end formed with threads, the threads being threadably positioned into the upper end of the support bar;

a plurality of clips, said clips being secured at spaced locations along the length of the post for supporting individual objects being formed with a pair of similarly shaped components, each component having an exterior flat section and angled interior sections to allow the pivoting thereof at an intermediate point to open and close the fingers of the clip, each clip also having a coil spring coupled between the opposed components tending to urge the fingers of the clip in a closed position; and an adhesive coupling the clips to the post at spaced locations along the length thereof for supporting individual objects.

* * * * *